US006245001B1

(12) United States Patent
Siaperas

(10) Patent No.: US 6,245,001 B1
(45) Date of Patent: Jun. 12, 2001

(54) MULTIPURPOSE EXERCISE APPARATUS

(76) Inventor: Matt Siaperas, 5016 Apache Dr., Pocatello, ID (US) 83201

( * ) Notice: Subject to any disclaimer, the term of this patent is extended or adjusted under 35 U.S.C. 154(b) by 0 days.

(21) Appl. No.: 09/379,925

(22) Filed: Aug. 24, 1999

(51) Int. Cl.[7] ..... A63B 21/00
(52) U.S. Cl. ..... 482/142; 482/123; 482/129
(58) Field of Search ..... 482/121, 126, 482/130, 142, 127, 131, 904, 104

(56) References Cited

U.S. PATENT DOCUMENTS

| | | | | |
|---|---|---|---|---|
| 2,676,015 | | 4/1954 | Courtney . | |
| 3,664,666 | * | 5/1972 | Lloyd | 482/142 |
| 4,198,044 | * | 4/1980 | Hollappa | 482/126 |
| 4,492,376 | | 1/1985 | Schatz et al. . | |
| 4,508,341 | | 4/1985 | Carrington . | |
| 5,232,426 | * | 8/1993 | Van Straaten | 482/142 |
| 5,542,898 | | 8/1996 | Wilkinson | 482/142 |
| 5,575,742 | | 11/1996 | Wu | 482/92 |
| 5,681,249 | | 10/1997 | Endelman | 482/142 |
| 5,697,870 | | 12/1997 | Osborn | 482/52 |

* cited by examiner

*Primary Examiner*—Jerome Donnelly
(74) *Attorney, Agent, or Firm*—Tom Hamill, Jr.

(57) ABSTRACT

A multipurpose exercise device is disclosed. The apparatus has a generally rectangular, boxlike main body. The top surface of the body is hinged transversely to create a storage container and an adjustable section that can be fixed at various angles in relation to the main body by using a pivotal adjustment arm extending the bottom of the boxlike body. In the first embodiment, a plurality of clip rings is provided along both the side of the boxlike main body and a depending inner lip of the adjustable upper section. The user may attach resistive elements to various of these clip rings to allow for a wide variety of different exercises. The resistive elements may be color coded to indicate greater or lesser resistance. The resistive elements are stored in the provided storage container within the main body when the apparatus is not in use. In a second embodiment, there is no depending inner lip on the pivoting sections.

13 Claims, 4 Drawing Sheets

FIG. 1
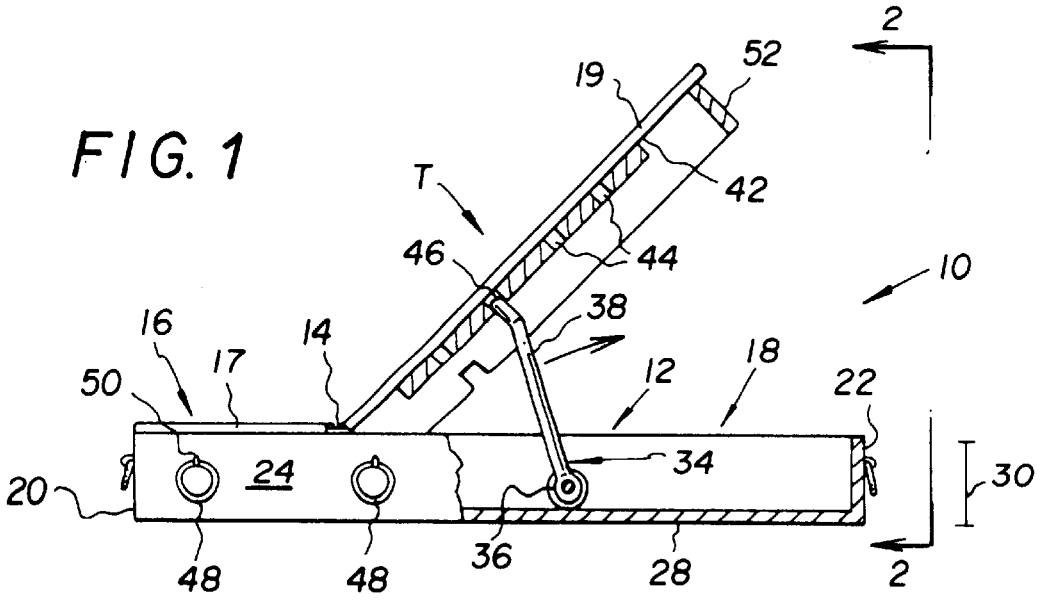
FIG. 2
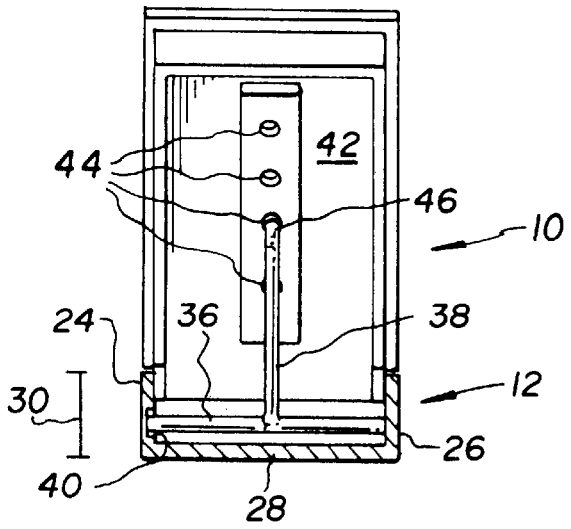
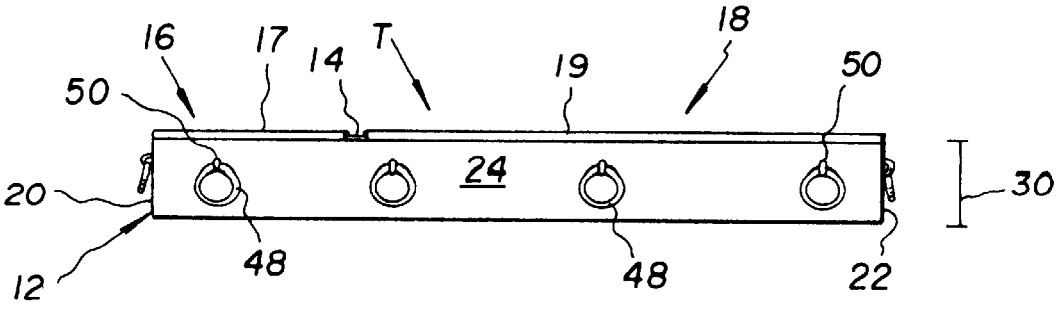
FIG. 3

MULTIPURPOSE EXERCISE APPARATUS

BACKGROUND OF THE INVENTION

1. Field of the Invention

The present invention relates generally to exercise equipment, and more particularly, to a multipurpose apparatus that allows the user to perform a variety of exercises and that is especially adapted to allow for a more entertaining and varied workout. More specifically, the device relates to exercise apparatus that include resistive elements removably attached to the body of the device. Even more specifically, it relates to exercise devices where the resistive elements may be attached at a plurality of locations on the body of the device.

2. Description of the Prior Art

Various exercise machines that allow the user to work out varied portions of the body are well known in the art of athletic equipment. Many exercise devices, including the present invention, utilize resistive elements to provide tension against which the user works. All of these devices have their drawbacks, one of which is the difficulty of storage and in the trouble that people of varied sizes, ages, skill levels, and strength have in exercising with the same machine. The present invention seeks to address these concerns and also provide a multipurpose exercise machine that is low in cost to manufacture and produce.

During a search at the U.S. Patent and Trademark Office, a number of relevant patents were uncovered and they will be discussed below.

U.S. Pat. No. 2,676,015 issued to William F. Courtney on Apr. 20, 1954 discloses an exercising table with a handgrip. This is clearly unlike the present invention in that there is no teaching of either the storage compartment of the present invention or of the clip rings for the elastic bands.

In U.S. Pat. No. 4,492,376 issued to Jack M. Schatz et al. on Jan. 8, 1985 there is taught a lower extremity exerciser. The exerciser involves tubes that fit into pegs and elastic straps that fit around the tubes to provide resistance. There is no teaching of the present invention's clip rings, nor of the adjustable hinged support and storage compartments in the body of the invention.

U.S. Pat. No. 5,232,426 issued to Villem J. Van Straaten on Aug. 3, 1993 discloses a exercising machine. This is clearly dissimilar from the present invention in that no elastic bands or attachment rings are taught.

Another Patent of interest is U.S. Pat. No. 4,508,341 issued to Michael R. Carrington on Apr. 2, 1985. This teaches a pass blocking sled with a elongated pivoting arm, an impacting surface, and a compressible spring. As in the above patents, there is no teaching of the various clip rings and elastic bands of the instant invention.

In U.S. Pat. No. 5,681,249 issued to Ken Endelman on Oct. 28, 1997 there is disclosed a convertible exercise apparatus. Unlike the present invention, no clip rings or storage compartment is taught.

Next is U.S. Pat. No. 5,697,870 issued to Mellisa Osborn on Dec. 16, 1997. This is a portable stepping exerciser with storage compartments. Unlike the present invention, there is no hinge to allow various angles between the main surface area and the storage area.

Another patent of interest is U.S. Pat. No. 5,542,898 issued to William T. Wilkinson on Aug. 6, 1996. This multifunction exercise and aerobic bench is dissimilar from the present invention in that there is no teaching of either the clip rings or the centrally mounted pivoting adjustment rod of the instant invention.

Lastly, U.S. Pat. No. 5,575 issued to Tien-Lai Wu on Nov. 19, 1996 discloses a multipurpose exercise apparatus. Unlike the present invention, there is no teaching of the various clip rings or the pivotal adjustment rod.

Thus, while the foregoing body of prior art indicates it to be well known to use various configurations of resistive elements and pivoting sections in the exercise device art, the provision of this more simple and cost effective device is not contemplated. Nor does the prior art described above teach or suggest a multipurpose exercise apparatus which may be used by individuals of varying skill and strength levels, as well as people of varying ages. In the existing art, many of the devices are expensive to manufacture and are bulky. The foregoing disadvantages are overcome by the unique structure of the present invention as will be made apparent from the following description thereof. Other advantages of the present invention over the prior art also will be rendered evident.

SUMMARY OF THE INVENTION

To achieve the foregoing and other advantages, the present invention, briefly described, provides a multipurpose exercise device with a generally rectangular, boxlike main body. The top surface of the body is hinged transversely to create a storage container and an adjustable section that can be fixed at various angles in relation to the main body by using a pivotal adjustment arm extending the bottom of the boxlike body. In the first embodiment, a plurality of clip rings is provided along both the side of the boxlike main body and a depending inner lip of the adjustable upper section. The user may attach resistive elements to various of these clip rings to allow for a wide variety of different exercises. The resistive elements may be color coded to indicate greater or lesser resistance. The resistive elements are stored in the provided storage container within the main body when the apparatus is not in use. In a second embodiment, there is no depending inner lip on the pivoting sections. It has also been contemplated that the bench will be able to be placed upon risers to permit the user to employ the bench as a step for aerobics activity.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining at least two preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

An object of the present invention is to provide a multipurpose exercise apparatus wherein user works against resistive elements.

Another object of the present invention is to provide a multipurpose exercise apparatus wherein the resistive elements may be stored within the main box-like body of the device.

Still a further object of the present invention is to provide a multipurpose exercise apparatus where the main box-like body of the device is transversely pivoted to create a main section and a storage section.

Still another object of the invention is to provide a multipurpose exercise apparatus where a plurality of ring clips is provided along the sides of the box-like main body allowing the resistive elements to be clipped in where the user desires, allowing a large number of various exercises to be done.

Still yet another object of the invention is to provide a multipurpose exercise apparatus wherein the pivoting main section includes a depending inner lip that also has a plurality of ring clips allowing further variety in placement of the resistive elements.

Still yet another object of the invention is to provide a multipurpose exercise apparatus wherein the pivoting main section is adjustably fixedly movable to a plurality of angles by means of a pivoting arm extending from the interior of the main body and engaging apertures on the bottom surface of the pivoting main section.

It is another object of the present invention to provide a multipurpose exercise apparatus which includes color coded resistance elements, where different colors indicate different resistance amounts.

It is a further objective of the present invention to provide a multipurpose exercise apparatus which is of durable and reliable construction.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein:

FIG. 1 is a partial cutaway side view of the first embodiment of the invention, showing the pivotal arm engaged with the apertures on the bottom surface of the hinged main section.

FIG. 2 is a partial cutaway view taken along line 2—2 in FIG. 1.

FIG. 3 is a side view of the first embodiment of the invention with both the main hinged section and the storage section closed.

DESCRIPTION OF THE PREFERRED EMBODIMENTS

Figure 4:
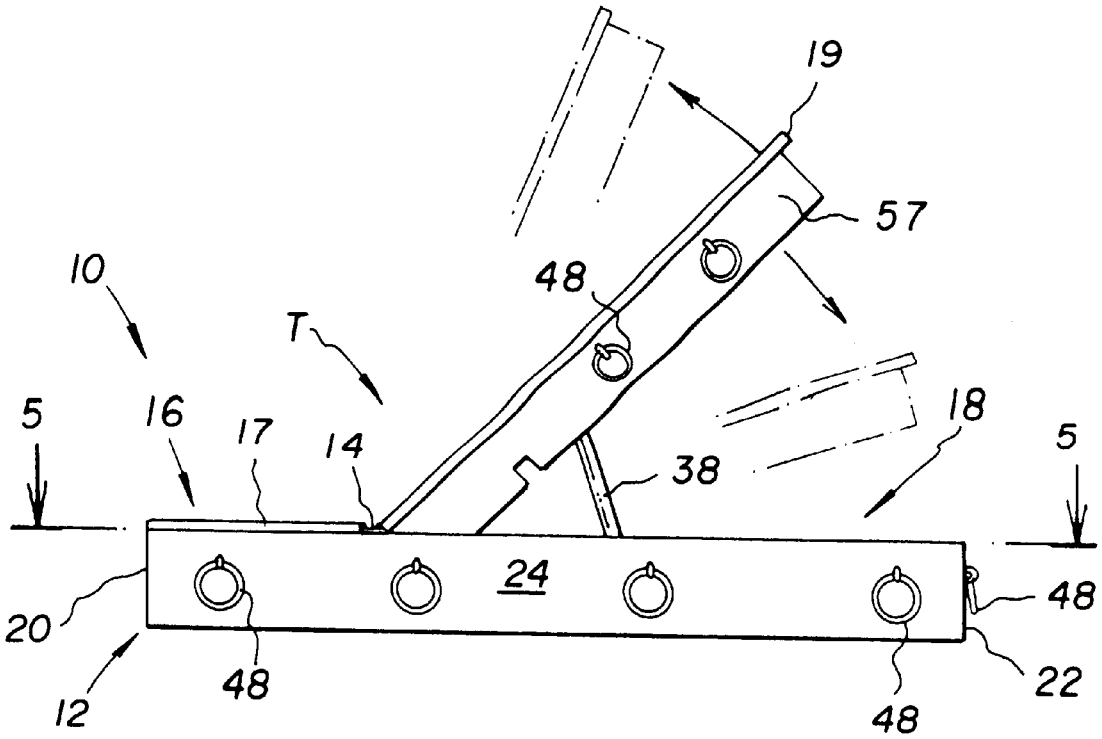
FIG. 4 is a side view of the first embodiment of the invention.
Figure 5:
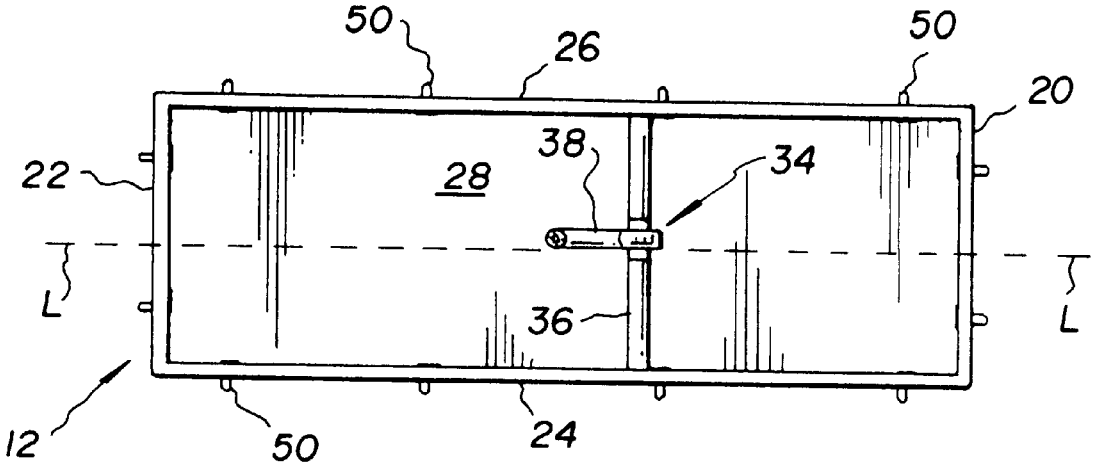
FIG. 5 is a cutaway view taken along line 5—5 in FIG. 4.

With reference now to the drawings, a multipurpose exercise apparatus embodying the principles and concepts of the present invention will be described.

Referring to FIGS. 1–5, the invention is indicated generally at 10. The top T of the main box-like body 12 is hinged as indicated at 14. The hinge 14 extends transversely perpendicular to the longitudinal axis L (seen in FIG. 5) to divide the main box-like body into a storage section 16 and a main section 18. The location of this hinge can be more clearly seen in the perspective view of a slightly modified version of the invention (FIG. 6), the hinges being substantially identical in both versions. Pin 80 secures the hinge 14A about the rotation axis. Pin 80 is received within a hinge aperture which goes from a first side of the bench to a second side of the bench. The pin 80 is secured on the second side by a push nut or other appropriate fastening means. The hinge 14 also divides the top T into storage section top 17 and main section top 19. It is contemplated that the uppermost surface of the top T would be made of or coated with a material having a high friction coefficient, such as textured rubber or the like. The top T should be of sufficient thickness to support the weight of an individual, as will be discussed further below. The main box-like body 12 has a first end 20 and a second end 22. First end 20 is proximate the storage section 16 and second end 22 is proximate the main section 18. Main box-like body 12 also has a first side 24 and a second side 26 distal from one another. Bottom 28 is designed to rest on a planar surface and the main box-like body 12 has a sufficient depth 30 to hold both the stored resistive elements 32 (discussed further below).

Attached to and resting in the main section 18 of the main box like body 12 is the pivoting arm assembly 34. This assembly engages with and maintains a desired angle of the main section top 19 in relation to the main box-like body 12. As can be best seen in FIGS. 1 and 2, the pivoting arm assembly 34 is generally T-shaped having a pivot arm base 36 and a pivot arm engagement section 38. Pivot arm base 36 engages the pivot arm base apertures 40 in first side 24 and second side within main section 18 of the box-like main body 12. This is best seen in FIG. 2, though only one of the pivot arm base apertures 40 is shown, it should be understood that its complementary aperture is substantially the same. On the underside 42 of the main section top 19 are a plurality of pivot arm engagement apertures 44. These are configures such that they will receive the end 46 of the pivot arm engagement section 38. As is shown in FIGS. 1 and 4, this allows the user to set a desired angle of the main section top 19 in relation to the main body 12.

Figure 6:
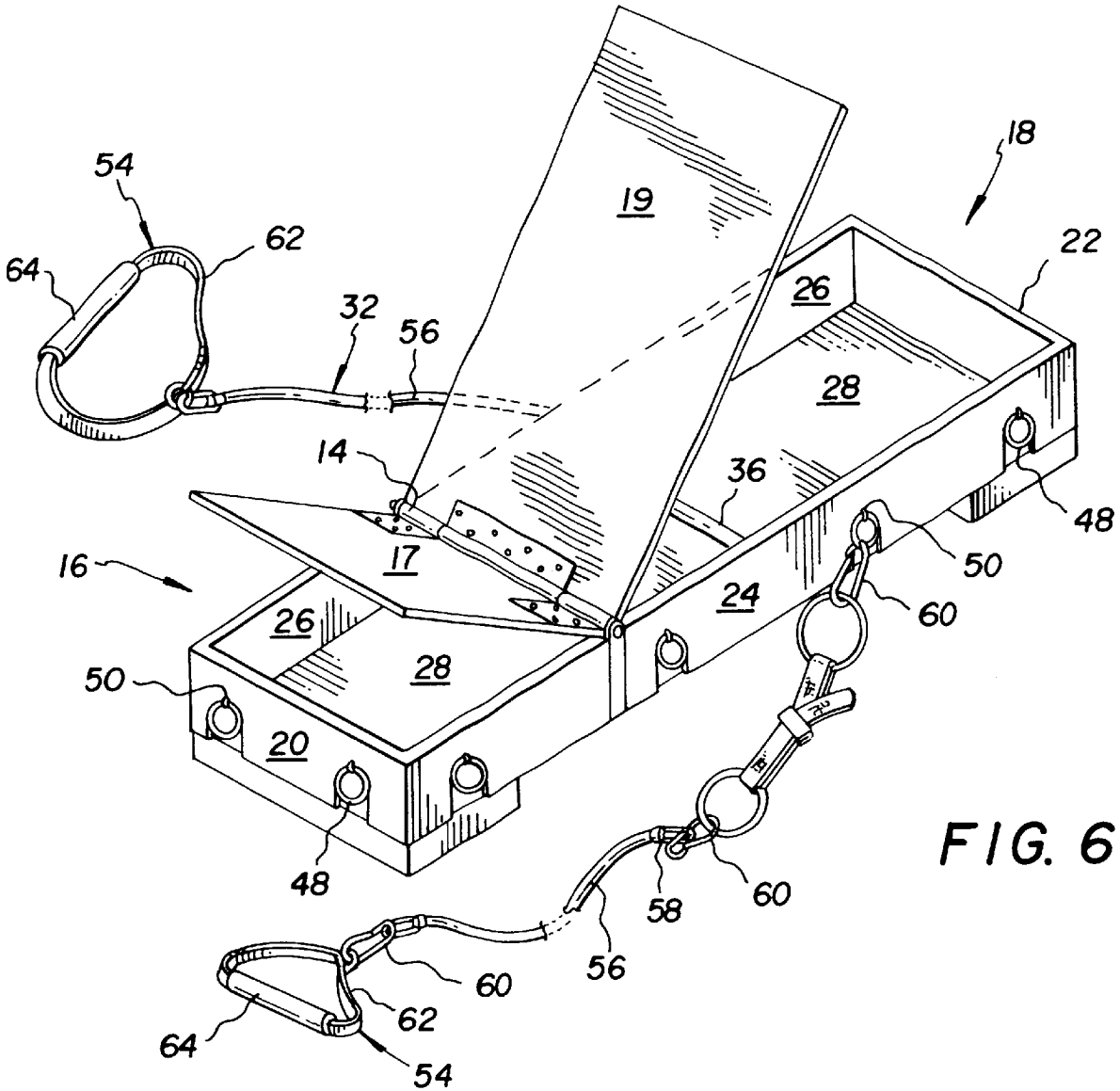
FIG. 6 is a perspective view of the second embodiment of the invention.
Figure 7:
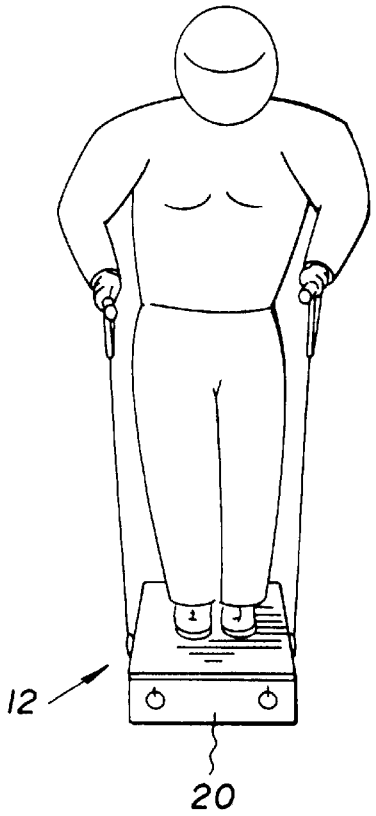
FIG. 7 is a front view showing a user doing a back exercise with the instant invention.

The discussion now turns to the means used to attach the resistive elements 32 to the device 10. In the versions of the invention described herein, this is accomplished by ring clips 48. Referring to FIG. 6, where the attachment means is shown most clearly, it can be seen that the ring clips 48 are generally circular and are attached to the main body 12 by generally U-shaped clips 50. The ring clips 60 are located in recessed areas of the main body 12. It is contemplated that these U-shaped clips 50 would be sized and configured such that the ring clips 48 could smoothly rotate through them. Note that these ring clips 48 are located on both body first end and second end 20, 22 and both body first side and second side 24, 26. In both embodiments shown herein, the ring clips 48 on each of the sides number four and the ring clips 48 on each of the first and second ends number two. It should be emphasized that the number of ring clips attached to the main box-like body 12 is variable and that the number depicted in the figures is for illustrative purposes only. In the first version, seen in FIGS. 1–5 there is a depending lip 52 extending from the underside 42 of the main section top 19. As is shown in FIG. 4, this depending lip 52 also has attached to it a pair of ring clips 48, attached by the U-shaped clips, generally similar to those described above. Turning to FIG. 6, illustrating a slightly different version of the invention, the depending lip 52 and its attendant ring clips and U-shaped clips, are omitted.

Also best seen in FIG. 6 are the resistive elements 32. In the embodiments described herein, these each consist of a grip portion 54, an elastic portion 56, and a ring clip engagement portion 58. It is contemplated that the ring clip engagement portion 58 would utilize a spring loaded snap ring, as seen indicated at 60, or some other type of known, easily manipulable engagement means. The grip portion as shown is a loop of material 62 having a tube of stiff material 64 placed over it to allow a user to grasp it firmly without slipping. The contemplated material to be used in the elastic portion 56 would be rubber tubing, though of course any number of materials, such as springs, could be utilized. The resistive elements may include a length adjustment feature to permit them to be lengthened or shortened. When the resistive elements are not in use, they may be stored in the storage section 16 of the main body 12 of the present invention. This lowers the possibility of them being misplaced. Furthermore, though only two of these resistive elements 32 are seen in the Figures, it should be understood that more could be supplied and utilized at the same time. By virtue of the unique construction of the instant invention, more than one person could conceivably use it at once, due to the plurality of ring clips 48 attached the body 12 and in the first version to the depending lip 52 of the main section top 19.

Figure 8:
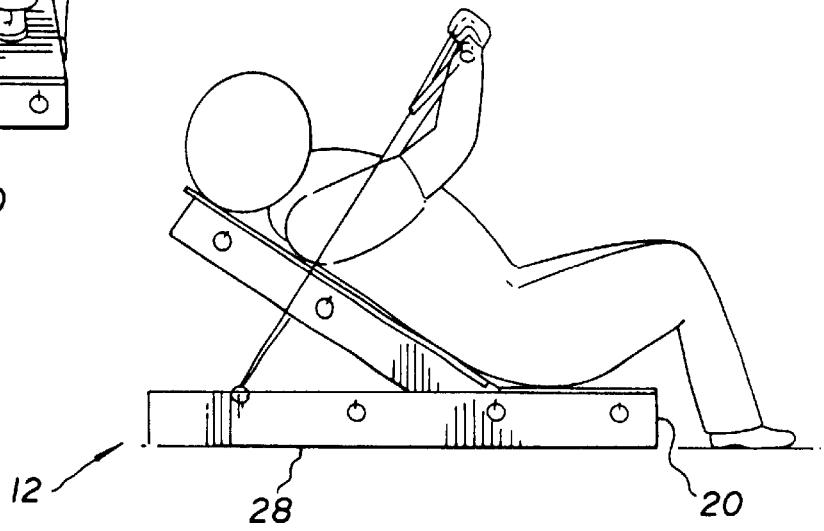
FIG. 8 is a side view of a user doing a chest strengthening exercise using the instant invention.
Figure 9:
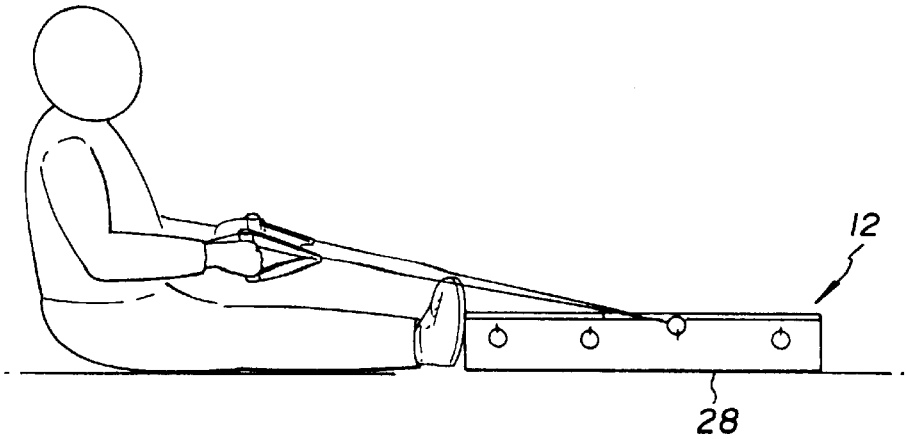
FIG. 9 is a side view of a user doing a rowing-type exercise using the present invention.

The unique construction of the present invention also allows for a wide variety of exercises to be performed by the user. In FIG. 6 it can be seen a user, by standing on the main body 12, can do back strengthening routines. In FIG. 8 it can be seen that, by sitting on the storage section top 17 and leaning back against the main section top 19, chest strengthening routines can be done. Note the wide variety of angles that the plurality of ring clips 48 allow for. By attaching the resistive elements 32 to various sets of opposing ring clamps 48, specific muscle groups can be targeted. In FIG. 9, a rowing type routine is pictured. Note that the box-like main body can also be used as a aerobic stepping box by and of itself. Various lengths of resistive elements could be supplied with the device to provide viable exercise routine for people of all sizes, ages, and strength levels.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred versions of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A multipurpose exercise apparatus comprising:

a box main body having a first end, a second end, a first side, a second side, a bottom, and a top, said main body having a longitudinal axis, said longitudinal axis being parallel to said first side and said second side;

said top including a hinge means, said hinge means located perpendicular to said longitudinal axis, said hinge means defining a storage section proximate said first end of said box main body and a main section proximate said second end of said box-like main body;

said hinge means further dividing said top into a storage section top and a main section top such that either said storage section top or said main section top can be moved radially about said hinge means to provide access to either said storage section or said main section;

a plurality of elastic resistive elements;

a plurality of ring clips on both said first side and said second side of said box main body; and detachable engagement means for attaching said elastic resistive elements to said ring clips; whereby a user attaches said elastic resistive elements to said engagement points on said box main body and by choosing predetermined of said ring clips may perform a variety of exercises.

2. The multipurpose exercise apparatus according to claim 1, wherein a plurality of ring clips are additionally located on said first end and said second end of said main body.

3. The multipurpose exercise apparatus according to claim 2, wherein said resistive elements comprise elastic rubber tubing including a gripping means.

4. The multipurpose exercise apparatus according to claim 3, wherein said detachable engagement means comprise ring clips on said box-like main body and snap rings on said resistive elements.

5. The multipurpose exercise apparatus according to claim 1, wherein said box main body further includes a pivoting arm assembly, said pivoting arm assembly comprising a pivot arm base engagement section extending laterally between said first side and said second side of said box main body and rotatably engageable therewith;

a pivot arm engagement section, adjustably engageable with said main section top, where said main section top includes a plurality of pivot arm engagement apertures for engaging said pivot arm engagement section, such that said main section top, when rotated around said hinge, may be fixed at a predetermined angle in relation to said box main body.

6. The multipurpose exercise apparatus according to claim 5, wherein a plurality of ring clips are additionally located on said first end and said second end of said main body.

7. The multipurpose exercise apparatus according to claim 6, wherein said resistive elements comprise elastic rubber tubing including a gripping means.

8. The multipurpose exercise apparatus according to claim 7, wherein said detachable engagement means comprise ring clips on said box-like main body and snap rings on said resistive elements.

9. A multipurpose exercise apparatus comprising:

a box main body having a first end, a second end, a first side, a second side, a bottom, and a top, said main body having a longitudinal axis, said longitudinal axis being parallel to said first side and said second side;

said top including a hinge means, said hinge means located perpendicular to said longitudinal axis, said hinge means defining a storage section proximate said first end of said box main body and a main section proximate said second end of said box main body;

said hinge means further dividing said top into a storage section top and a main section top such that either said storage section top or said main section top can be moved radially about said hinge means to provide access to either said storage section or said main section;

and where said box main body further includes a pivoting arm assembly, said pivoting arm assembly comprising a pivot arm base engagement section extending laterally between said first side and said second side of said box main body and rotatably engageable therewith;

a pivot arm engagement section, adjustably engageable with said main section top, where said main section top includes a plurality of pivot arm engagement apertures for engaging said pivot arm engagement section, such that said main section top, when rotated around said hinge, may be fixed at a predetermined angle in relation to said box main body:

a plurality of elastic resistive elements;

a plurality of engagement points on both said first side and said second side of said box main body; and detachable engagement means for attaching said elastic resistive elements to said ring clips; whereby a user attaches said elastic resistive elements to said ring clips on said box main body and by choosing predetermined of said ring clips, may perform a variety of exercises.

10. The multipurpose exercise apparatus according to claim 9, wherein a plurality of ring clips are additionally located on said first end and said second end of said main body.

11. The multipurpose exercise apparatus according to claim 10, wherein said resistive elements comprise elastic rubber tubing including a gripping means.

12. The multipurpose exercise apparatus according to claim 11, wherein said detachable engagement means comprise ring clips on said box main body and snap rings on said resistive elements.

13. A multipurpose exercise apparatus comprising:

a box main body having a first end, a second end, a first side, a second side, a bottom, and a top, said main body having a longitudinal axis, said longitudinal axis being parallel to said first side and said second side;

said top including a hinge means, said hinge means located perpendicular to said longitudinal axis, said hinge means defining a storage section proximate said first end of said box main body and a main section proximate said second end of said box main body;

said hinge means further dividing said top into a storage section top and a main section top such that either said storage section top or said main section top can be moved radially about said hinge means to provide access to either said storage section or said main section;

said main section top including a depending lip, said depending lip nested in said main body, a plurality of elastic resistive elements;

a plurality of ring clips on said first side of said box main body and said second side of said box main body and said depending lip; and detachable engagement means for attaching said elastic resistive elements to said ring clips; whereby a user attaches said elastic resistive elements to said engagement points on said box main body and by choosing predetermined of said ring clip, may perform a variety of exercises.

* * * * *